US007610670B2

(12) United States Patent
Akino

(10) Patent No.: US 7,610,670 B2
(45) Date of Patent: Nov. 3, 2009

(54) METHOD FOR MANUFACTURING A DIAPHRAGM ASSEMBLY

(75) Inventor: Hiroshi Akino, Machida (JP)

(73) Assignee: Kabushiki Kaisha Audio-Technica, Machida-shi, Tokyo (JP)

( * ) Notice: Subject to any disclaimer, the term of this patent is extended or adjusted under 35 U.S.C. 154(b) by 243 days.

(21) Appl. No.: 11/477,925

(22) Filed: Jun. 30, 2006

(65) Prior Publication Data

US 2006/0265861 A1 Nov. 30, 2006

(51) Int. Cl.
*H04R 31/00* (2006.01)

(52) U.S. Cl. ..... 29/594; 29/609.1; 29/876; 29/877; 29/886; 181/158; 216/62; 216/66; 216/67; 381/174; 381/191; 381/361; 438/3; 438/42; 438/57; 438/98

(58) Field of Classification Search ..... 29/594, 29/602.1, 609.1, 876, 877, 886; 381/174, 381/191, 361; 181/158; 216/62, 66, 67; 438/3, 42, 57, 98
See application file for complete search history.

(56) References Cited

U.S. PATENT DOCUMENTS 5,014,322 A * 5/1991 Yasuda et al. ..... 381/174
5,038,459 A * 8/1991 Yasuda et al. ..... 29/594
5,879,724 A * 3/1999 Sakamoto ..... 425/385
7,287,327 B2 * 10/2007 Ito et al. ..... 29/886

FOREIGN PATENT DOCUMENTS

JP 57044399 A * 3/1982

* cited by examiner

*Primary Examiner*—Paul D Kim
(74) *Attorney, Agent, or Firm*—Manabu Kanesaka

(57) ABSTRACT

A diaphragm assembly used for a condenser microphone has a diaphragm made of a resin film including a metallized film on one surface of a supporter ring. The diaphragm is made by a first step of bonding a ring jig of a larger diameter than the supporter ring to the resin film having the metallized film composed of a ductile metallic material on the one surface via an adhesive without exerting tension on the resin film; a second step of heating and contracting the resin film bonded to the ring jig without applying the tension at a temperature over a glass transition point of a film material; and a third step of bonding the supporter ring to the resin film via an adhesive in a state of exerting predetermined tension on the resin film. The diaphragm assembly is cut out of the resin film after the adhesive becomes hardened.

4 Claims, 2 Drawing Sheets

METHOD FOR MANUFACTURING A DIAPHRAGM ASSEMBLY

TECHNICAL FIELD

The present invention relates to a method for manufacturing a diaphragm assembly used for a condenser microphone, and in particular, to the method for manufacturing the diaphragm assembly which operates normally even if bias voltage is increased for the sake of increasing sensitivity of the condenser microphone and the condenser microphone including the diaphragm assembly.

BACKGROUND ART

A condenser microphone has a diaphragm made of a resin film and having a metallized film on one surface set up on a supporter ring (diaphragm ring) to render it as a diaphragm assembly, forms a condenser by placing the diaphragm assembly and a fixed pole oppositely via a spacer and converts a sound wave to an electrical signal according to change in capacitance due to displacement of the diaphragm oscillated by the sound wave.

Direct-current bias voltage is applied to this converter (except a microphone of an oscillation detecting method). Sensitivity of the condenser microphone depends on the bias voltage, and the sensitivity can be increased by increasing the bias voltage.

However, electrostatic attraction acts on the diaphragm between itself and the fixed pole. Therefore, if the bias voltage over a limit of stability is applied, the diaphragm is attracted to and eventually contacts the fixed pole side so that the microphone becomes no longer operational. In that case, a central portion of the diaphragm contacts the fixed pole first. If the bias voltage is further increased, its contact range expands to a periphery of the diaphragm.

SUMMARY OF THE INVENTION

Thus, an object of the present invention is to obtain a diaphragm assembly of a condenser microphone of which a diaphragm does not contact (is not absorbed in) a fixed pole side even if bias voltage is increased. Another object is to provide the condenser microphone capable of applying high bias voltage to a converter in order to have good sensitivity.

To achieve the objects, the present invention is a method for manufacturing a diaphragm assembly used for a condenser microphone and having a diaphragm made of a resin film including a metallized film on one surface set up on a supporter ring, comprising: a first step of bonding a ring jig of a larger diameter than the supporter ring to a resin film having a metallized film composed of a ductile metallic material on one surface via an adhesive without exerting tension on the resin film; a second step of heating and contracting the resin film bonded to the ring jig without applying the tension at a temperature over a glass transition point of that film material; and a third step of bonding the supporter ring to the resin film via the adhesive in a state of exerting predetermined tension on the resin film and cutting the diaphragm assembly out of the mother resin film after waiting for hardening of the adhesive.

According to this, the ring jig of a larger diameter than the supporter ring (diaphragm ring) is bonded to the resin film having the metallized film composed of the ductile metallic material on one surface via the adhesive without exerting tension on the resin film in the first step, and then the resin film bonded to the ring jig is heated and contracted without applying the tension at the temperature over the glass transition point of that film material so as to eliminate internal stress of the resin film in the second step, and the supporter ring is bonded to the resin film via the adhesive in the state of exerting the predetermined tension on the resin film and the diaphragm assembly is cut out of the resin film after hardening of the adhesive in the third step. As for this diaphragm assembly, the metallized film is plastically deformed by extending in a direction for having the tension applied thereto due to its ductility while the internal stress due to the tension remains in the resin film. Therefore, the diaphragm is supported by the supporter ring in the state of having the tension for rendering the metallized film side convex applied thereto. Thus, it is possible to place the diaphragm assembly to be opposed to the fixed pole with the metallized film on the side opposite to the fixed pole so as to have the internal stress remaining in the resin film counter electrostatic attraction due to bias voltage generated between the diaphragm and the fixed pole. When separated from the supporter ring, the diaphragm according to this manufacturing method is deformed to become round with the metallized film outside due to the internal stress remaining in the resin film.

As a preferred aspect, the resin film is heated at a predetermined temperature in the third step. It is thereby possible to leave the internal stress due to the tension more strongly in the resin film.

The present invention includes the condenser microphone provided with the diaphragm assembly manufactured by the manufacturing method. To be more specific, it is the condenser microphone including the converter consisting of the diaphragm assembly having the diaphragm set up on the supporter ring and the fixed pole oppositely placed via the spacer, wherein the diaphragm assembly manufactured by the manufacturing method is provided as the diaphragm assembly.

According to this, it is possible to place the diaphragm assembly to be opposed to the fixed pole with the metallized film on the side opposite to the fixed pole so as to have the internal stress remaining in the resin film counter electrostatic attraction due to bias voltage generated between the diaphragm and the fixed pole. Therefore, the diaphragm operates normally even if higher bias voltage is applied, and the condenser microphone with high sensitivity is provided.

DETAILED DESCRIPTION

Next, an embodiment of the present invention will be described by using FIGS. 1 to 3. However, the present invention is not limited thereto. FIGS. 1A to 1J are pattern diagrams for describing steps included in a method for manufacturing a diaphragm assembly according to the present invention, FIGS. 2A to 2C are partially enlarged sectional views for describing states of transition of a resin film in the steps, and FIG. 3 is an exploded sectional view showing an example of a converter provided to a condenser microphone of the present invention.

Figure 1A:
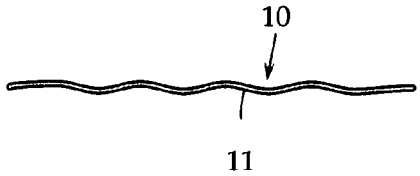
FIGS. 1A to 1J are pattern diagrams for describing steps included in a method for manufacturing a diaphragm assembly according to the present invention.
Figure 2A:
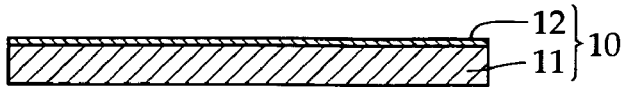
FIGS. 2A to 2C are partially enlarged sectional views for describing states of transition of a resin film in the steps.

According to the method for manufacturing a diaphragm assembly of the present invention, a resin film 11 is prepared first as a base material of a diaphragm 10 of the condenser microphone shown in FIG. 1A. As shown in FIG. 2A, the resin film 11 is a resin film including a metallized film 12 on one surface, and is a mother film of a size including at least one, or preferably two or more sheets of the diaphragm 10 configuring the diaphragm assembly.

As for the resin film 11, a polymer film is preferably adopted, such as PET (polyethylene terephthalate), PPS (polyphenylene sulfide) or PEN (polyethylene naphthalate). The present invention requires a condition that the metallized film 12 is ductile (malleable). In that sense, a metallized film of gold (Au) is optimal.

Thickness of the resin film 11 may be selected in a range of 1 to 10 μm. Thickness of the metallized film 12 is preferably between several tens of angstroms to 1,000 angstroms. As for an evaporation method, a vacuum evaporation method is common. However, another evaporation method may also be used.

Figure 1B:
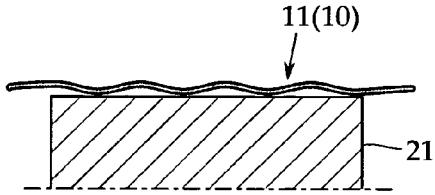

Next, the resin film 11 is put on a flat table 21 as shown in FIG. 1B. In that case, it is preferable to temporarily fix the resin film 11 without applying the tension thereto by electrostatic absorption, negative-pressure absorption or the like.

Figure 1C:
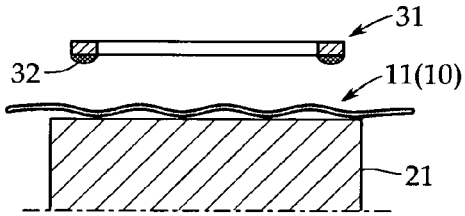
Figure 1D:
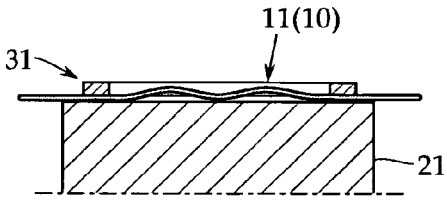

As shown in FIGS. 1C and 1D, a ring jig 31 is bonded to the resin film 11 via an adhesive 32. In this case, no tension should be applied to the resin film 11. The ring jig 31 is a ring of a larger diameter than a supporter ring 41 of the diaphragm shown in FIG. 1H for instance, and is separated from the resin film 11 in a final step. A silicon sealant (RTB rubber) is preferably used for the adhesive 32.

Figure 1E:
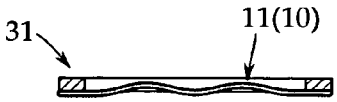
Figure 1F:
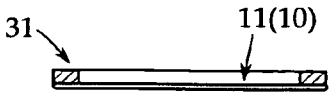

As shown in FIG. 1E, a surplus film sticking out of the ring jig 31 is cut away, and then the film is heated at a temperature for contracting it sufficiently without applying the tension so as to contract the resin film 11 as shown in FIG. 1F. The heating temperature in this case is over a glass transition point of that film material. Over 120° C. and over 2 hours are preferable in general. The resin film 11 contracts and its internal stress is eliminated in this heating step.

Figure 1G:
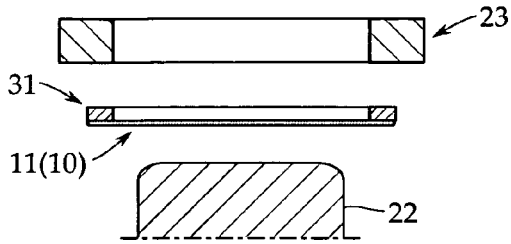
Figure 1H:
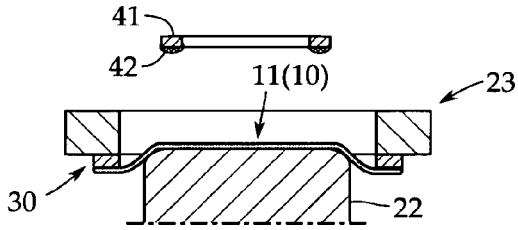

Next, a tension providing step shown in FIGS. 1G to 1I will be described. As shown in FIG. 1G, a table 22 having a flat surface and a smaller diameter than the ring jig 31 and a weight 23 are prepared in this step. As shown in FIG. 1H, the resin film 11 is put on the table 22 and the weight 23 is placed on the ring jig 31.

Figure 2B:
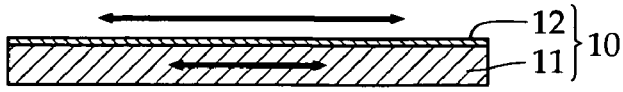
Figure 2C:
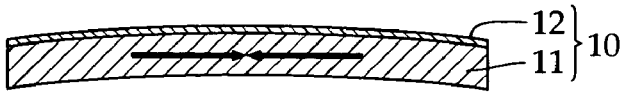
Figure 3:
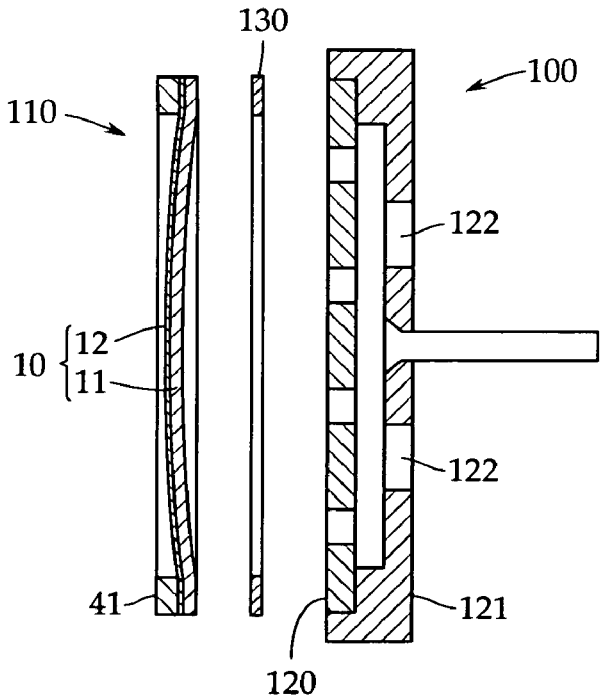
FIG. 3 is an exploded sectional view showing an example of a converter provided to a condenser microphone of the present invention.

Thus, the tension is applied to the resin film 11 in an arrow direction shown in FIG. 2B, and the metallized film 12 is extended. In this state, the supporter ring 41 is bonded to the resin film 11 via a two-component epoxy adhesive 42 for instance, and is then heated at 70° C. for two hours or so for instance so as to harden the adhesive 42. If the adhesive 42 hardens, the film is cut along an outside diameter of the supporter ring 41 to take out a diaphragm assembly 110 shown in FIG. 1J.

As for the diaphragm assembly 110, the metallized film 12 is plastically deformed by extending in a direction for having the tension applied thereto due to its ductility in the foregoing tension providing step while the internal stress due to the tension remains in the resin film 11. Therefore, the diaphragm 10 is supported by the supporter ring 41 in the state of having the tension for rendering the metallized film 12 side convex applied thereto as exaggeratedly shown in FIG. 2C. When separated from the supporter ring 41, the diaphragm 10 is deformed to become round with the metallized film 12 outside due to the internal stress remaining in the resin film 11.

Figure 1I:
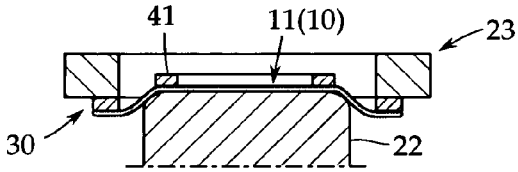
Figure 1J:
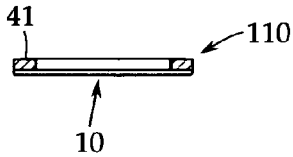

In the case of using an ultraviolet cure adhesive for instance as the adhesive of the supporter ring 41, the heating for hardening the adhesive in the step of FIG. 1I is no longer necessary. To leave the internal stress due to the tension strongly in the resin film 11, however, it is preferable to heat it at 70° C. for two hours or so for instance as with the example even in the case of using the adhesive requiring no heating such as the ultraviolet cure adhesive.

It is also possible, by using a ring jig several times larger than the supporter ring 41 as the ring jig 31, to simultaneously take a large number of the diaphragm assemblies 110 out of a sheet of the mother resin film 11 of a large size.

Next, a converter 100 provided to the condenser microphone of the present invention will be described by using FIG. 3. The diaphragm assembly 110 manufactured by the manufacturing method is used for the converter 100.

The converter 100 is configured by combining the diaphragm assembly 110 having the diaphragm 10 set up on the supporter ring 41 with a fixed pole 120 supported by an electrical insulating seat 121 oppositely via an electrical insulating spacer 130 of predetermined thickness.

In this case, the diaphragm 10 of the diaphragm assembly 110 is supported by the supporter ring 41 so that the metallized film 12 side becomes convex due to the internal stress provided to the resin film 11 as previously described and exaggeratedly shown in FIG. 3. Therefore, the metallized film 12 side is placed to be opposed to the fixed pole 120 as the side opposed to the fixed pole.

Electrostatic attraction acts between the diaphragm 10 and the fixed pole 120 due to direct-current bias voltage applied to the converter 100. According to the present invention, however, the internal stress of the resin film 11 acts in the direction for going away from the fixed pole 120 so as to alleviate a failure due to absorption of the diaphragm even when the bias voltage is increased. Therefore, it is possible to realize the condenser microphone of which sensitivity and stability are both high.

The converter 100 of FIG. 3 is shown as a unidirectional unit including a rear acoustic terminal 122. However, directionality may be arbitrary. It is also applicable to an electret condenser microphone.

The present application is based on, and claims priority from, Japanese Application Serial Number JP2005-151930, filed May 25, 2005, the disclosure of which is hereby incorporated by reference herein in its entirety.

The invention claimed is:

1. A method for manufacturing a diaphragm assembly used for a condenser microphone and having a diaphragm made of a resin film including a metallized film on one surface set up on a supporter ring, comprising:

a first step of bonding a ring jig of a larger diameter than the supporter ring to the resin film having the metallized film composed of a ductile metallic material on one surface via an adhesive without exerting tension on the resin film;

a second step of heating and contracting the resin film bonded to the ring jig without applying the tension at a temperature over a glass transition point of a film material; and a third step of bonding the supporter ring to the resin film via an adhesive in a state of exerting predetermined tension on the resin film and cutting the diaphragm assembly out of the resin film after waiting for hardening of the adhesive, wherein the resin film is heated at a predetermined temperature after bonding the resin film to the supporter ring and before cutting the resin film in the third step.

2. A method for manufacturing a diaphragm assembly used for a condenser microphone, comprising:

preparing a diaphragm made of a resin film including a metallized film composed of a ductile metallic material on one surface;

bonding a ring jig to the resin film having the metallized film by an adhesive without exerting tension on the resin film;

cutting the resin film outside the ring jig;

heating and contracting the resin film bonded to the ring jig without applying tension at a temperature over a glass transition point of a film material;

applying tension equally to the resin film inside the ring jig;

bonding a supporter ring only to the resin film with the tension being applied by an adhesive, said supporter ring having a diameter smaller than that of the ring jig so that the supporter ring is disposed inside the ring jig; and cutting the resin film along the supporter ring after waiting for hardening of the adhesive.

3. The method for manufacturing a diaphragm assembly according to claim 2, wherein the resin film is heated at a predetermined temperature for hardening the adhesive after bonding the resin film to the supporter ring and before cutting the resin film.

4. The method for manufacturing a diaphragm assemble according to claim 3, wherein in applying tension to the resin film inside the ring jig, the resin film with the ring jig is placed on a table having a diameter smaller than that of the ring jig, and a weight is placed on the ring jig.

* * * * *